US007267475B2

(12) United States Patent
Steele

(10) Patent No.: US 7,267,475 B2
(45) Date of Patent: Sep. 11, 2007

(54) BLENDER

(75) Inventor: James R. Steele, Stillwater, MN (US)

(73) Assignee: Dynamic Air Inc., St. Paul, MN (US)

( * ) Notice: Subject to any disclaimer, the term of this patent is extended or adjusted under 35 U.S.C. 154(b) by 429 days.

(21) Appl. No.: 10/442,464

(22) Filed: May 21, 2003

(65) Prior Publication Data

US 2004/0233776 A1 Nov. 25, 2004

(51) Int. Cl.
*B01F 13/02* (2006.01)

(52) U.S. Cl. ..... 366/101; 366/106

(58) Field of Classification Search ..... 366/101, 366/106; 406/137; 222/195
See application file for complete search history.

(56) References Cited

U.S. PATENT DOCUMENTS 2,084,546 A * 6/1937 Ahlmann ..... 366/106
2,618,290 A * 11/1952 Van Vliet ..... 137/510
3,097,828 A 7/1963 Groin
3,386,182 A 6/1968 Lippert ..... 34/10
3,647,188 A 3/1972 Solt
4,325,495 A 4/1982 Mokris ..... 222/1
4,326,810 A 4/1982 Schofield ..... 366/106
4,375,335 A 3/1983 Klein-Albenhausen ..... 366/15
4,472,062 A 9/1984 Balzau et al. ..... 366/106
4,534,653 A 8/1985 Coutray ..... 366/106
4,595,296 A 6/1986 Parks ..... 366/106
4,943,163 A 7/1990 Steele ..... 366/106
4,944,598 A 7/1990 Steele ..... 366/106
5,693,263 A * 12/1997 Meekel et al. ..... 261/64.3
6,629,773 B2 * 10/2003 Parks ..... 366/107

* cited by examiner

*Primary Examiner*—Tony G. Soohoo
(74) *Attorney, Agent, or Firm*—Jacobson & Johnson

(57) ABSTRACT

A mixing apparatus and method wherein the mixing apparatus includes a hopper having a port piston for periodically retracting to open a fluid port to allow a slug of gas to be quickly injected into the bottom of a hopper, which produces a mixing and blending of the materials in the hopper as the slug of gas flows upward through the materials in the hopper. The port piston periodically closes to seal the fluid port without allowing the material in the hopper to backflow, which would prevent between the port piston and a hopper sealing member from being brought into sealing engagement.

21 Claims, 3 Drawing Sheets

BLENDER

FIELD OF THE INVENTION

This invention relates generally to blenders and, more specifically, to blenders that blend the contents therein through periodic injection of a slug of fluid into the blender.

CROSS REFERENCE TO RELATED APPLICATIONS

None.

STATEMENT REGARDING FEDERALLY SPONSORED RESEARCH OR DEVELOPMENT

None.

REFERENCE TO A MICROFICHE APPENDIX

None.

BACKGROUND OF THE INVENTION

The concept of blending is old in the art with the art replete with various types of blenders for mixing solids or liquids. In one type of blending or mixing device paddles or agitators stir the contents of the hopper. Still other blending or mixing devices inject air into a chamber to agitate the contents of the chamber.

One type of flow mixing device for mixing solids such as dry granular materials is shown in my U.S. Pat. No. 4,944,958 wherein air is injected into a stream of dry granular materials to mix the granular materials as the mixed granular materials flows out a discharge port located at the bottom of the vessel.

Another type of device for flow mixing liquids is shown in U.S. Pat. No. 4,595,296 where as a liquid flows through a tank a bubble of air is periodically injected into the liquid at the bottom of the tank to mix the liquid as it flows through the tank and out a discharge port at the bottom of the tank.

Still another device for mixing fine grain material is shown in U.S. Pat. No. 3,097,828. In this device a plurality of nozzles are circumferentially spaced around a conical shaped head so that a gas under pressure can be directed thorough the fine grain material located in a cylindrical container. In this device, the contents of the container are churned upwards and mixed together through the sheer turbulence of the gas stream.

My U.S. Pat. No. 4,943,163 shows another type of blender for pneumatically mixing a batch of dry granular material. The invention includes a set of poppet valves that are circumferentially spaced around the bottom of the hopper with the poppet valves periodically injecting air under sufficient pressure so as to lift the batch of material off the bottom of the blender and then allow the material to drop to cause the materials to be blended together as the batch of material is repeatedly lifted and dropped.

U.S. Pat. No. 4,326,810 shows a mixing devices for powder materials where a set of nozzles are activated in a predetermined sequence to mix the powder material.

Another device for mixing granular particle materials is shown in U.S. Pat. No. 3,386,182 wherein the material in the container is fluidized by series of jets located at the bottom of the container with one of the jets having a higher velocity than the other jets.

The present invention comprises a hopper blender wherein granular or solid materials in the hopper are mixed or blended through periodic injection of a slug of fluid through a fluid port located at the bottom of the hopper. The fluid port is sealable through a slidable piston, which is cycled between a closed port condition and an open port condition. The slug of fluid is at sufficient energy so as to overcome the weight of a column of granular material located above the fluid port and at sufficient proximity to prevent backflow into the fluid port If the fluid is gas or which is lighter than the granular materials, the fluid flows upward allow the slug of gas to percolate upward through the granular materials to blend the materials in the hopper blender.

SUMMARY OF THE INVENTION

Briefly, the invention comprises a mixing apparatus including a hopper having a port piston located at least partially in a plenum chamber for periodically retracting to open a fluid port to allow a slug of gas to be quickly injected into the bottom of a hopper, which produces an in situ mixing and blending of the materials in the hopper as the slug of gas flows upward through the materials in the hopper. The port piston periodically closes to seal the fluid port without allowing the material in the hopper to backflow into the plenum chamber, which could prevent the port piston and a sealing member from being brought into sealing engagement.

DESCRIPTION OF THE PREFERRED EMBODIMENT

Figure 1:
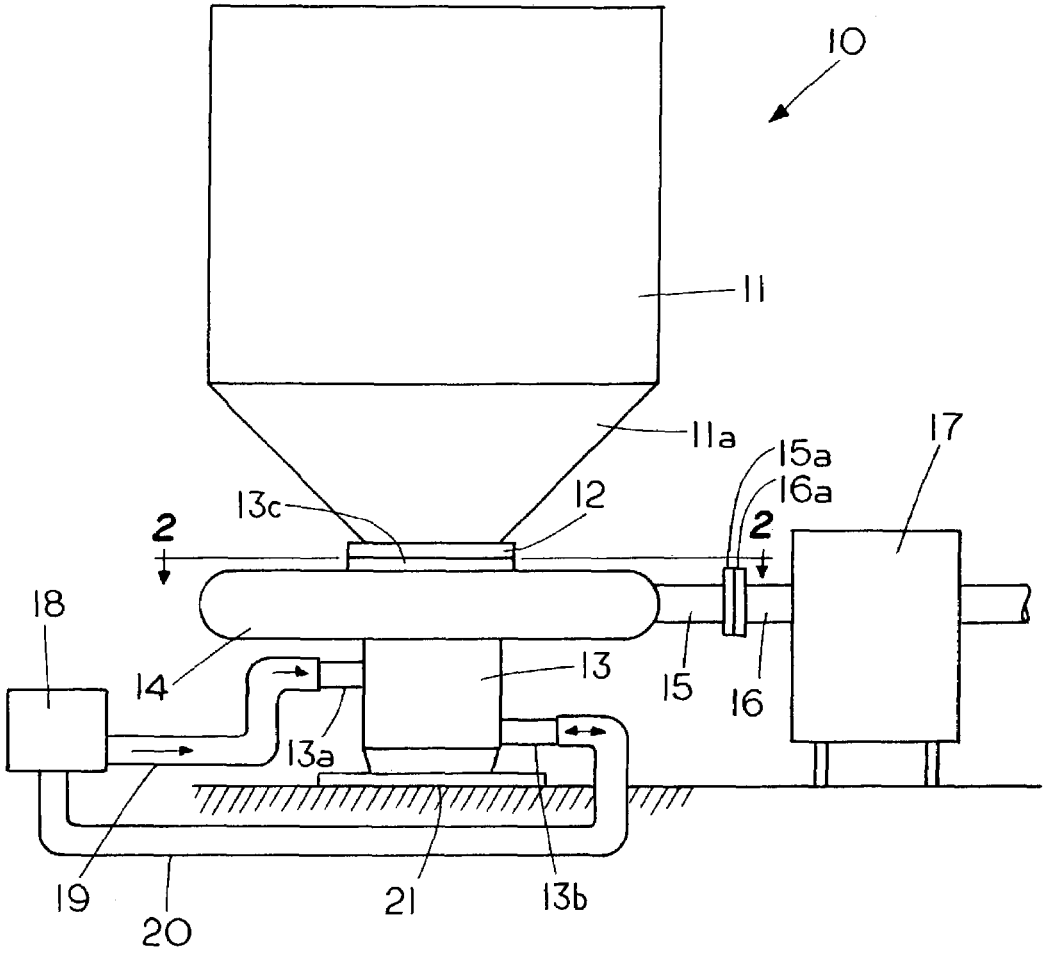
FIG. 1 is a side view of the apparatus for blending and mixing materials.

FIG. 1 shows a side elevation view of the apparatus for blending and mixing materials 10 having a cylindrical shaped hopper 11 with a conical shaped bottom 11*a* terminating in an inlet flange 12. A support housing 13 having a flanged foot 21 on one end and a flanged collar 13*c* on the other end supports hopper 11. Located circumferentially around housing 13 is a fluid duct that forms a circumferential plenum housing 14 which connects to a source of pressurized fluid 17, such as air or other gases, through a duct 16 and a duct 15 that are flange connected to each other by flanges 15*a* and 16*a*.

A control module 18 having a fluid duct 19 connects to a fluid port 13*a* on one side of housing 13 for ingress and egress of an actuation fluid therethrough. Similarly, located on the other side of housing 13 is another fluid duct 13*b* that connects to control module 18 through fluid port 20 for ingress or egress of an actuation fluid therethrough.

Figure 2:
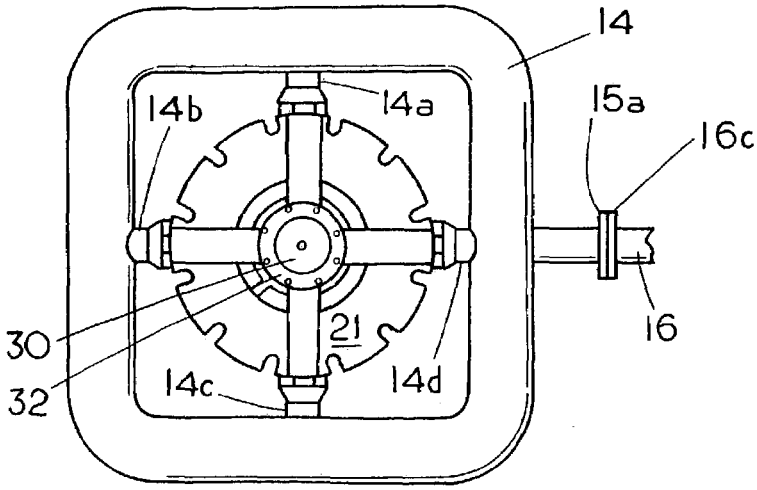
FIG. 2 is a section view of the apparatus for blending and mixing materials taken along lines 2-2 of FIG. 1.

FIG. 2 shows a top view of the generally square shaped circumferential plenum housing 14 with a set of inlet ducts 14*a*, 14*b*, 14*c* and 14*d* spaced equal distance around the plenum housing 14. The purpose of the plenum housing 14 is store a large volume or reservoir of pressurized fluid in proximity to a fluid injector port 32*a* (see FIG. 3). By quickly opening the fluid port 32*a* a slug of fluid can be instantly injected into hopper 11 without material backflow into the fluid port 32*a*. Similarly, closing the fluid port 32*a* while fluid continues to flow from the reservoir of pressurized fluid in plenum housing 14 prevents backflow into the fluid injector port 32*a*.

Figure 3:
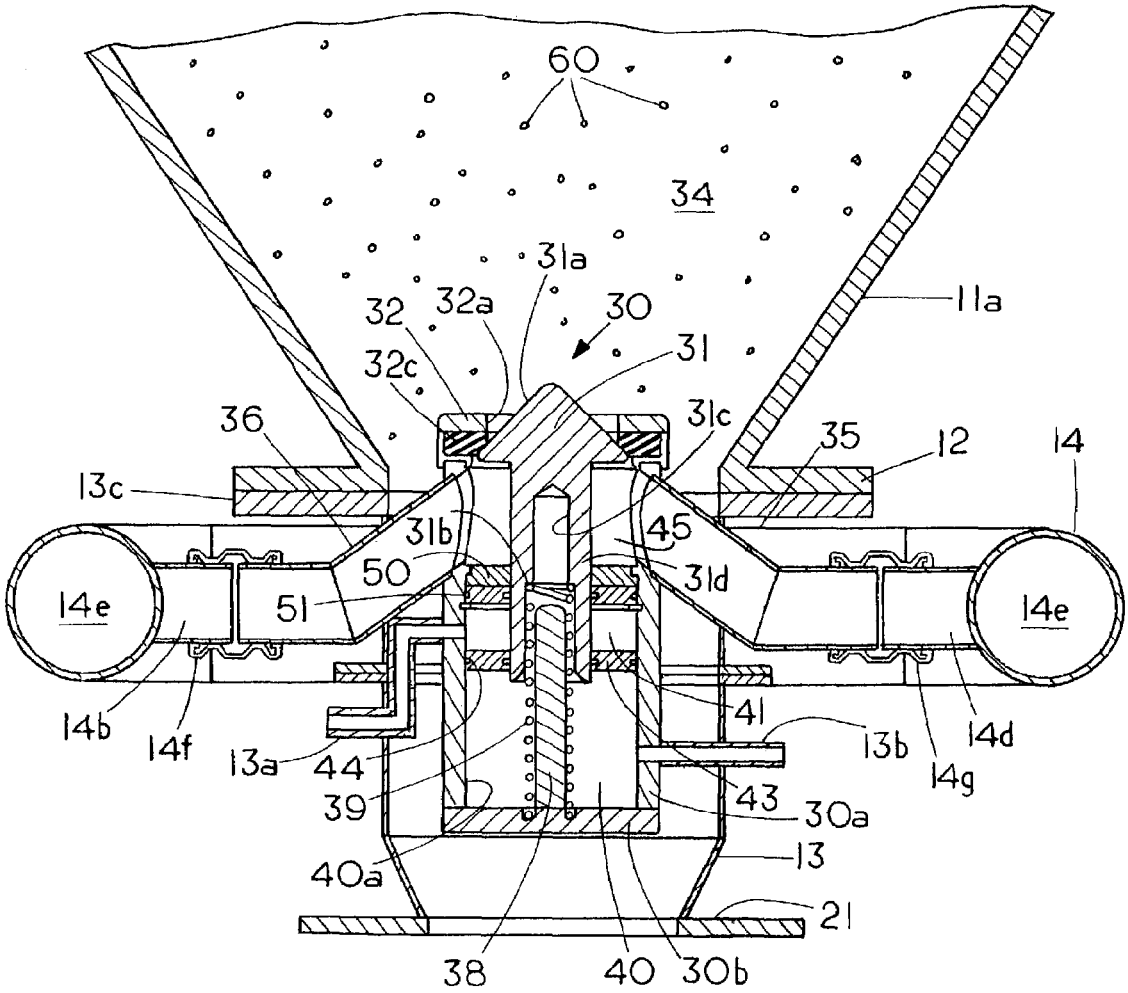
FIG. 3 is a section view showing the slidable conical piston in the apparatus for blending and mixing materials in a closed condition.

Centrally located in FIG. 3 is fluid port flange 32 and fluid port 32*a* opening vertically upward with conical piston head 31*a* is centrally located in fluid port 32*a*.

FIG. 3 shows the apparatus for blending and mixing materials of FIG. 1 in partial cross section revealing the conical converging hopper bottom 11*a* and flange 12 in engagement with flange 13*c*. A granular material 60, which is to be in situ blended, is located in hopper chamber 34. In order to periodically inject a slug of fluid such as air into the granular material there is provided a fluid injector 30. Located in fluid injector 30 is a port piston 31 having a conical head 31*a* on one end and a cylindrical recess or sleeve 31*c* on the other end.

Located on the top portion of fluid injector 30 is an annular fluid port sealing member 32*c* that is supported under rigid flange 32, which has a circular port opening 32*a* therein for flow of a slug of pressured fluid into hopper 11. FIG. 3 shows the conical head 31 in the closed condition with the sealing member 32*c* in engagement with a lower annular portion of conical piston head 31. In the closed condition port piston 31 and sealing member 32*c* prevent material 34 in hopper 11*a* from falling into an annular piston plenum chamber 45 which is located beneath the conical head 31*a* of piston 31. FIG. 3 shows that the annular piston plenum chamber 45 houses port piston 31 so that any retractable displacement of port piston 31 with respect to seal 32*c* immediately allows fluid in piston plenum chamber 45 to flow into hopper 11*a*.

The piston plenum chamber 45 connects to one side of the circumferential plenum chamber 14*e* in circumferential plenum housing 14 through a radial duct 35 and plenum duct 14*d*, with the ducts secured to each other through pipe connector 14*g*. Similarly, the opposite side of piston plenum chamber 45 connects to one side of the circumferential plenum chamber 14*e* in circumferential plenum housing 14 through a radial duct 36 and plenum duct 14*b*, with the ducts secured to each other through pipe connector 14*f*. Circumferential plenum chamber 14*c* also connects to piston plenum chamber 45 through two additional fluid ducts 14*a* and 14*c* through fluid ducts (not shown) to allow flow of fluid from plenum chamber 14*e* into plenum chamber 45. The use of the serial plenum chambers allows one to store a large reservoir of pressurized fluid proximate the port 32*a* so that a large volume of fluid i.e. a slug of fluid, can be quickly injected into the hopper 11*a* without concern that once introduced fluid pressure will drop occur allowing a material backflow condition to occur that can block the fluid port 32*a* thereby rendering the system inoperable.

Port piston 31 is part of a double piston system. As shown in FIG. 3, located on the underside of port piston 31 is a cylindrical shaft 31*d* with a second cylindrical piston 43 fixedly secured to the opposite end of cylindrical shaft 31*d*. Cylindrical piston 43 is an actuation piston 43 and includes a slidable sealing member 44, such as an elastomer or polymer sealing ring, that slides along the internal cylindrical surface 40*a* of fluid injector housing 13 to maintain the lower end of shaft 31*d* concentric with respect to fluid injector housing 30*a*. A collar 50 and a collar bearing sleeve 51, which are affixed to the fluid injector housing 30 hold the shaft 31*d* in concentric sliding engagement with fluid injector housing 30*a*

Located on one side of actuation piston 43 is a first annular actuation chamber 41 which is formed by shaft 31*d* and fluid injector housing wall 30*a*. Located on the opposite side of actuation piston 43 is a second annular actuation chamber 40, which is formed by fluid injector housing 30 and a guide rod 38. Guide rod 38 is secured to fluid injector housing bottom member 30*b* and extends upward into the sleeve 31*c*.

Actuation piston 43, which is a driver piston, is slidable in housing 13 in response to fluid actuation signals through fluid port 13*a* and fluid port 13*b*. A cylindrical compression spring 38 extends around a cylindrical extension 38 with one end of spring 38 engaging injector housing 30*b* and the other end engaging a shoulder 31*b* to maintain port piston 31 in a normal upward sealing condition even when there is no actuation pressure in actuation chambers 40 or 41 and to provide a return force to quickly return port piston 31 to the closed condition when the actuation signal is removed from chamber 41.

As can be seen in FIG. 3, the granular material 60 in the hopper which is to be mixed or blended extends into hopper bottom 11*a*. When port piston 31 is in the closed condition, as illustrated in FIG. 3, the conical piston head 31*a* of polt piston 31 is in sealing engagement with sealing member 32*c* to prevent granular material 60 from backflowing past the port piston 31 and into the piston plenum chamber 45. In order to ensure that the port piston 31 can be rapidly sealed it is preferred to make the port piston 31 of a lightweight material such as aluminum, which minimizes the inertia to overcome as the port piston 31 moves from the open condition to the closed condition. In addition, to rapidly closing the fluid port 32*a* compression spring 39 provides a restoring force and if desired the pressure in chambers 40 and 41 can be controlled to provide a return force on lower drive piston 43. Spring 39 is sufficiently strong so that in the event of actuation pressure failure in chamber 41 spring 39 can provide a sufficient upward force to maintain the piston 31 in sealing relationship with seal 32*c* even though the weight of the material in hopper chamber 34 exerts a downward opening force on piston 31. In addition, compression spring 39 provides a restoring force to assist in overcoming the inertia of port piston 31 and assist in driving the port piston 31 to the closed condition illustrated in FIG. 3.

Figure 4:
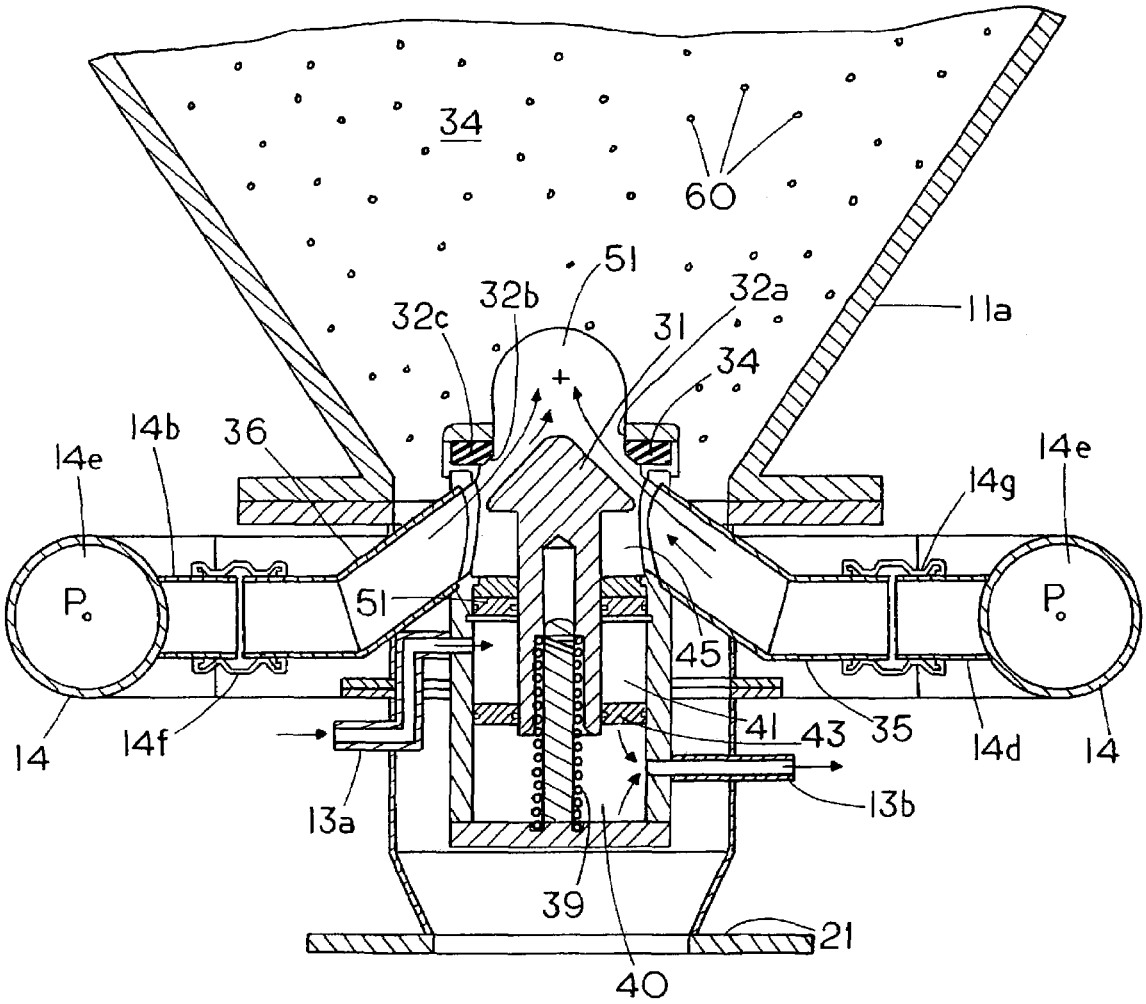
FIG. 4 is a section view showing the slidable conical piston in the apparatus for blending and mixing materials in an open condition.

FIG. 4 shows the in situ blending apparatus of FIG. 3 in the open condition. In the open condition piston 31 is retracted or displaced downward from seal 32*c*. In order to quickly displace position 31 downward a high pressure activation signal is introduced into chamber 41 though port 13*a* while fluid in chamber 40 is allowed to escape or is drawn off through port 13*b*.

The retraction of piston 33 from annular seat 32*b* allows a slug of pressurized fluid 51 in piston plenum chamber 45 to flow upward along the conical face of piston 31 and into the granular material and at the same time blow away granular material 60 away from the seat 32*b*. The conical face of piston causes the fluid in plenum chamber 45 to flow toward the center of the hopper rather than radially outward. The introduction of the pressurized fluid from piston plenum chamber 41 performs a dual function. First, the maintaining of a piston plenum chamber 45, which is radially fed by a larger plenum chamber 14*e*, allows one to rapidly deliver sufficient fluid into the materials 60 which prevents the material 60 from falling into the plenum chamber 45 as the piston 31 is retracted. Second, the flow of fluid, which in the preferred embodiment is air, scours both the seal surface 32*b* and the face of the conical piston 31 thus ensuring that both surfaces will be in a clean condition for resealing when the port piston 31 is brought to the up or closed condition as shown in FIG. 3.

Thus the present invention includes the method of in situ blending, comprising placing a blendable material into hopper 11 and supplying a pressurized fluid to a piston plenum chamber 45. One periodically retracts a port piston 31 to inject a slug of fluid in the plenum chamber 45 into the hopper 11 through a fluid port 32*a*. Next, one closes the fluid port 31*a* by bring the port piston 31 into sealing engagement with the elastomer sealing member 32*a* while the slug of fluid is flowing therethrough to prevent backflow past the port piston 31.

To assist in preventing back flow one can include the step of resiliently biasing the port piston 31 with a spring 38 to maintain the port piston 31 in a closed condition without a pressure assistance from the actuation fluid. To ensure that sufficient fluid can be injected into the hopper a set of plenum chambers 41 and 14*e* are connected to each other with the more remote plenum chamber 14*e* being substantially larger than the piston plenum chamber 41 to ensure that fluid pressure conditions can be maintained in piston plenum chamber 41 that will prevent backflow of material therein.

In order to decrease the inertia of the port piston one can include the step of making the port piston a lightweight material such as aluminum to decrease the inertia required to change the port piston from an opening condition to a closing condition.

The method of in situ blending includes the step of injection a slug of fluid in a vertical upward direction through a single centrally located port located in the bottom of the hopper while the material is retained above the port in the hopper.

I claim:

1. An in situ blender comprising:

a hopper containing a granular material to be blended;

a fluid injector, said fluid injector having a fluid port in fluid communication with said hopper;

a flange located on a top portion of said fluid injector;

an annular fluid port sealing member located under said flange;

a port piston located at least partially in said fluid port of said fluid injector, said port piston having a closed port condition when said port piston is in sealing engagement with said fluid port sealing member, said closed port condition preventing back flow into said fluid port, said piston spaceable downward from said sealing member to bring said port piston into an open port condition whereby in the open port condition a slug of pressurized fluid can flow along a face of the piston and into the granular material in the center of the hopper.

2. The blender of claim 1 wherein the port piston has a conical head and a source of pressurized fluid where the pressurized fluid is at sufficient energy so that a column of particles in said hopper are prevented from back flowing into the fluid injector when the

3. The blender of claim 2 wherein the port piston is made of aluminum and the sealing member comprises an elastomer.

4. The blender of claim 1 wherein the port piston is located in a plenum chamber.

5. The blender of claim 1 wherein the port piston has a conical head for forming sealing engagement with an annular elastomer sealing member.

6. An in situ blender comprising:

a hopper;

a fluid injector, said fluid injector having a fluid port in fluid communication with said hopper;

a fluid port sealing member;

a port piston located at least partially in said fluid port of said fluid injector, said port piston having a closed port condition when said port piston is in sealing engagement with said fluid port sealing member, said closed port condition preventing back flow into said fluid port, said piston spaceable from said sealing member to bring said port piston into an open port condition to allow a slug of gas to flow through the fluid port and into the hopper; and a remote plenum chamber wherein the remote plenum chamber has a set of equally spaced fluid ducts for directing fluid into a smaller piston plenum chamber with the port piston located at least partially in the piston plenum chamber.

7. The blender of claim 6 wherein the port piston includes a shaft secured to a downstream side of said port piston and an actuator chamber therearound with a drive piston located in said actuator chamber, said drive piston connected to said shaft of said port piston so that pressurization of a one side of said drive piston brings said port piston to the open condition and pressurization on an opposite side of said drive piston bring said port piston to the closed condition.

8. The blender of claim 7 wherein the source of pressurized fluid comprises a source of pressurized air.

9. The blender of claim 8 wherein the hopper has a single fluid injector therein with said single fluid injector located in a coaxial condition with respect to said hopper.

10. A blender for blending solid materials comprising:

a hopper;

a fluid injector, said fluid injector having a fluid port for periodically injecting a slug of fluid into a lower portion of said hopper said fluid injector having a fluid injector housing including an annular sealing member for forming a sealing engagement;

a piston plenum chamber in said fluid injector housing;

a port piston having a conical head, said port piston retractable into said piston plenum chamber to allow a slug of gas in the piston plenum chamber to be injected into the lower portion of the hopper, said port piston extendible into a closed condition to prevent back flow of materials past the port piston during the extension of the port piston into the closed condition;

a second fluid injector housing; and a second plenum chamber in said second fluid injector housing wherein said second plenum chamber is a circumferential plenum chamber with multiple radial flow passages for simultaneously directing fluid from the second plenum chamber into the piston plenum chamber, said second plenum chamber larger than the piston plenum chamber to provide a reservoir of fluid for injecting into the hopper.

11. The blender of claim 10 wherein the port piston includes a shaft extending therefrom with a driver piston secured thereto.

12. The blender of claim 11 wherein the driver piston is slidable mounted in an injector housing having a fluid chamber proximate each of a face of said driver piston to enable pressure actuation of said driver piston.

13. The blender of claim 12 including a compression spring for maintain a biasing closing force on the port piston.

14. The blender of claim 13 including a control module for controlling the amount of actuation fluid into a fluid chamber proximate the face of said driver piston.

15. The method of in situ blending comprising:

placing a blendable material into a hopper;

supplying a pressurized fluid to a plenum chamber;

periodically retracting a port piston, that normally supports the blendable material in the hopper to thereby inject a slug of the fluid in the plenum chamber into the hopper through a fluid port; and closing the fluid port by bringing the port piston into sealing engagement while the slug of fluid is flowing therethrough to prevent backflow past the port piston.

16. The method of claim 15 including using an actuation fluid to drive a driver port piston connected to said port piston from the closed condition to the open condition and vice versa.

17. The method of claim 15 including the step of resiliently biasing the port piston to normally maintain the port piston in a closed condition.

18. The method of claim 15 including making the port piston of a lightweight material to decrease the inertia required to change the port piston from an open condition to a close condition.

19. The method of claim 15 including the step of injection the slug of fluid through a single port opening vertically upward.

20. The method of claim 15 wherein the step of injecting a slug of fluid comprises injecting a slug of air vertically upward into the hopper while the material is confined in the hopper.

21. The method of claim 15 wherein the step of supplying fluid from a plenum chamber comprises supplying from a larger remote plenum chamber to the plenum chamber to maintain a pressure condition in the plenum chamber at sufficient energy level so as to prevent backflow therein.

* * * * *

UNITED STATES PATENT AND TRADEMARK OFFICE

CERTIFICATE OF CORRECTION

PATENT NO. : 7,267,475 B2
APPLICATION NO. : 10/442464
DATED : September 11, 2007
INVENTOR(S) : James R. Steele It is certified that error appears in the above-identified patent and that said Letters Patent is hereby corrected as shown below:

In column 5, line 62 after “when the” insert --pressurized fluid is introduced into the hopper.--.

In column 6, line 65 delete “slidable” and insert therefor --slidably--.

In column 8, line 7 delete “close” and insert therefor --closed--.

In column 8, line 16 after “supplying” insert --fluid--.

Signed and Sealed this

Eleventh Day of December, 2007

JON W. DUDAS
*Director of the United States Patent and Trademark Office*